United States Patent [19]

Purnell

[11] 4,314,646

[45] Feb. 9, 1982

[54] DEVICES FOR SUPPORTING HANGING PLANTS

[76] Inventor: Robert C. Purnell, Fishkill Park, Rte. 52, Fishkill, N.Y. 12524

[21] Appl. No.: 952,246

[22] Filed: Oct. 16, 1978

Related U.S. Application Data

[63] Continuation of Ser. No. 812,255, Jul. 1, 1977, abandoned.

[51] Int. Cl.[3] ..... A47F 5/08

[52] U.S. Cl. ..... 211/113; 47/67

[58] Field of Search ..... 211/113, 118, 117, 123, 211/105.1; 47/39, 67; 248/340, 318, 323, 215; 362/122, 145; D6/113; 108/29; 160/19

[56] References Cited

U.S. PATENT DOCUMENTS

| | | | |
|---|---|---|---|
| 2,708,711 | 5/1955 | McGinty et al. | 160/19 X |
| 2,788,888 | 4/1957 | Fisk | 211/118 X |
| 2,796,925 | 6/1957 | Woodward | 160/19 |
| 3,066,445 | 12/1962 | D'Amico | 47/39 X |
| 3,314,192 | 4/1967 | Park | 47/39 X |
| 3,664,063 | 5/1972 | Ware | 47/39 |
| 3,950,637 | 4/1976 | Rodin | 248/318 X |
| 4,108,084 | 8/1978 | Fink | D6/113 X |

FOREIGN PATENT DOCUMENTS

| | | | |
|---|---|---|---|
| 684086 | 4/1964 | Canada | 211/118 |
| 2390897 | 1/1979 | France | 47/39 |

*Primary Examiner*—Roy D. Frazier
*Assistant Examiner*—Robert W. Gibson, Jr.
*Attorney, Agent, or Firm*—Philip Furgang

[57] ABSTRACT

Disclosed herein is a device for hanging plants which comprises a pair of spaced board-like members. Disposed perpendicularly between and joining the boards are dowels. The dowels have apertures therethru for receiving and supporting a rod. The dowels are so spaced such that the rod passes through aligned apertures in the dowels. The rod is disposed at least midway within and between the spaced boards so that the hook of a hanger for a hanging plant, or the like, suspended from the rod, is substantially hidden from view.

In an alternative embodiment, a fluorescent fixture may be disposed about the dowels so as to provide lighting for the plants.

13 Claims, 11 Drawing Figures

FIG. 1
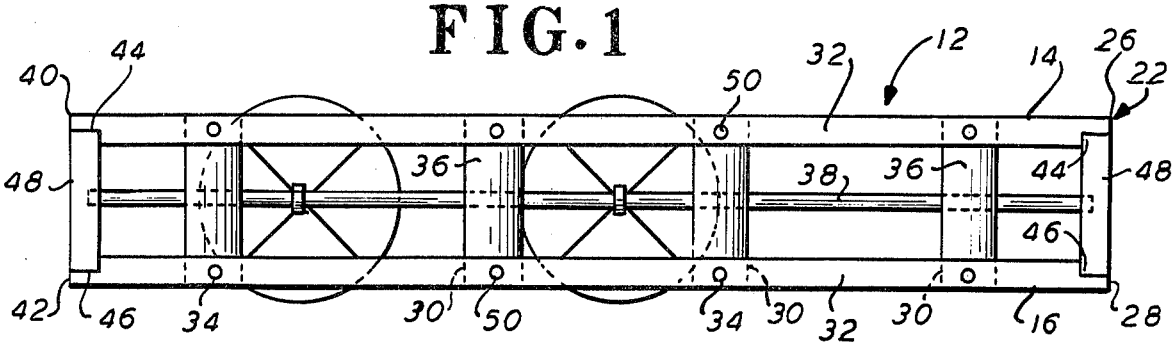
FIG. 2
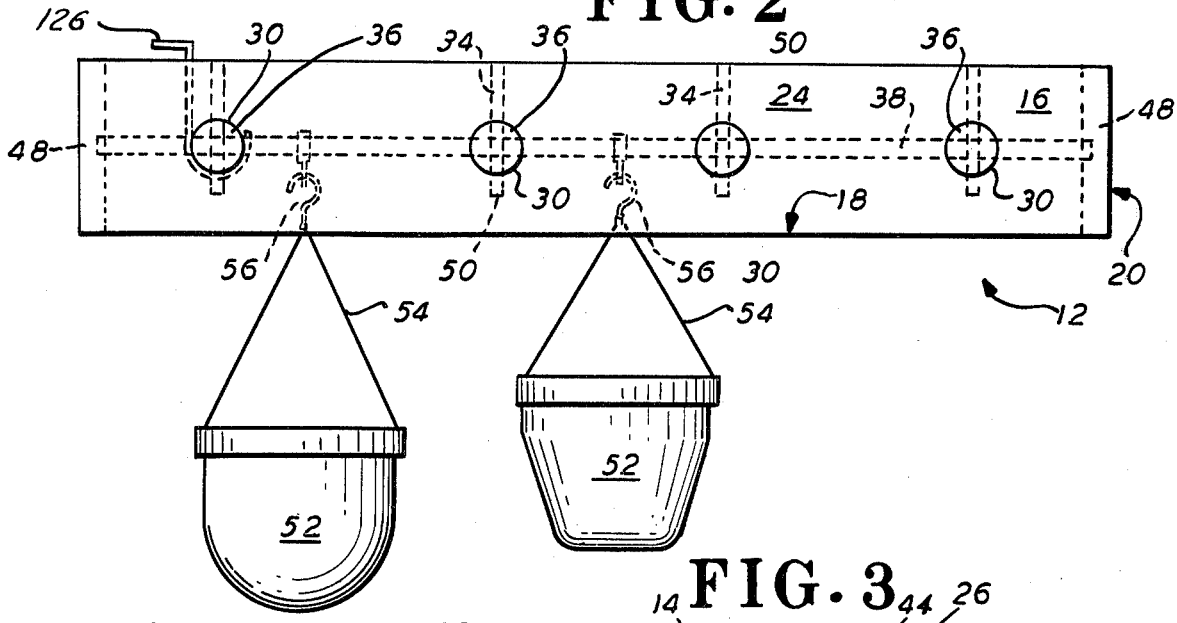
FIG. 3
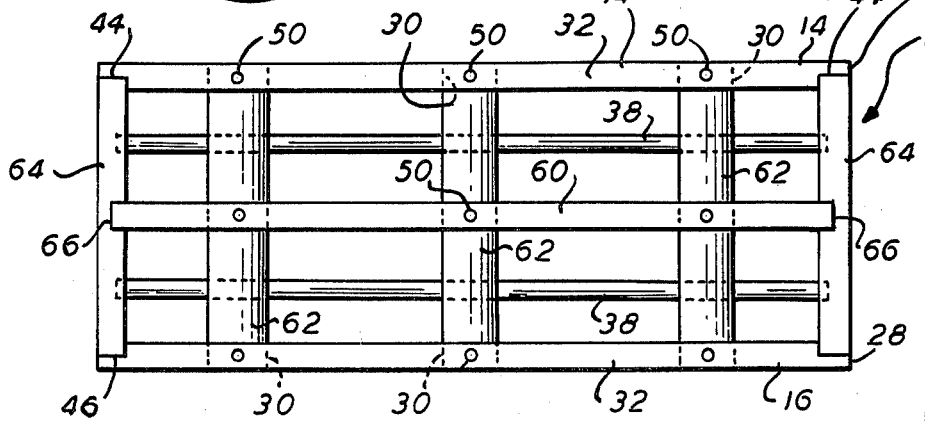
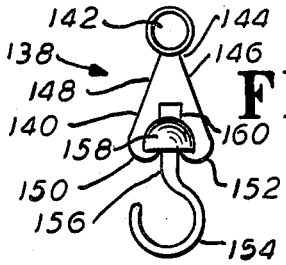
FIG. 10
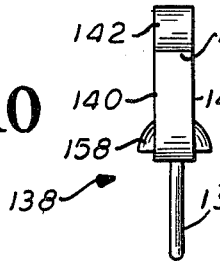
FIG. 11
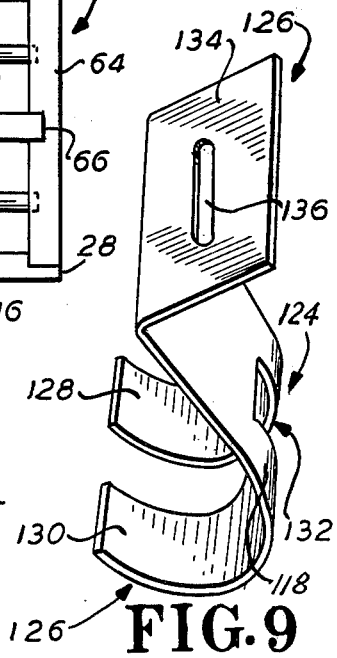
FIG. 9

DEVICES FOR SUPPORTING HANGING PLANTS

This is a continuation of application Ser. No. 812,255, filed July 1, 1977, now abandoned.

BACKGROUND OF THE INVENTION

This invention relates to apparatus for supporting growing plants and, more particularly, to a support for holding hanging plant containers.

Throughout the specification and claims, reference to hanging plants will be understood to apply to such hanging objects as pots, pans, and other articles.

It is well known to support plants by providing, for example, a pair of spaced rails dimensioned to retain thereupon flower pots or the like, which are secured to a wall in much the same manner as a shelf. Such a device has been disclosed by Macaw, in U.S. Pat. No. 1,300,629.

It is also known to provide trays in which potted plants may be rested, such as that proposed by D'Amico, in U.S. Pat. No. 3,066,445.

It is further known to suspend plants or other objects by means of hangers in which the hooks engaged are part of the plant stand, as in the device disclosed by Duffee et al., in U.S. Pat. No. 379,637 or in which the plants are suspended from bars or brackets, as indicated by the devices disclosed by Shumaker, in U.S. Pat. No. 2,770,919, Gallo, in U.S. Pat. No. 3,967,578, and Rodin, in U.S. Pat. No. 3,950,637.

All of the afore-mentioned plant stands or means for suspending hanging plants have a common disadvantage: the mechanical interconnection, such as the bar or the hook of the hanger which hangs on the bar, or other means, is clearly visible. As a consequence, from a structural point of view, the plant stand provides an unfinished look.

Furthermore, if a fluorescent or other lighting fixture is to be used in connection with the plant stand, it is not uncommon, as in the device provided by Ware, in U.S. Pat. No. 3,664,063, that the fluorescent fixture, itself, is entirely visible, thus detracting from the displayed plants.

SUMMARY OF THE INVENTION

An object of this invention is to provide a support for hanging plants which maximizes the displayed plants and minimizes the intrusion of the mechanical engagement of the plant container with the stand or support.

It is another object of this invention to provide a plant stand or support for hanging plants which obscures from view the rod, upon which the hook of the hanger is engaged.

It is still another object of this invention to provide a plant stand or support which serves as a lighting fixture, as well.

It is a further object of this invention to provide a plant support which is simple in construction, has a high degree of functionality, and is economic in manufacture.

It is a further object of this invention to provide an artificial source of light together with means to support and suspend botanical specimens.

It is another object of this invention to provide a simplified and decorative support fabricated from inexpensive and readily available standard hardware.

Thus, in accordance with the teachings of this invention, there is provided a support for plants, the support being of the type intended to receive thereon plant containers in which the containers are suspended from hooks. The support comprises at least one rigid member. There is provided, further, a rod-like member which is spaced from the rigid member along the length thereof, so that it can receive the hook, the rigid member being wider than the rod-like member. The rod-like member is disposed within the width of the rigid member, so that the rod may be substantially obscured from view by the rigid member. There is also provided joining means, secured to the rod and the rigid member. The rigid member is thereby being supported by the rod, the joining means spacing the rod from the rigid member.

Further objects and advantages of the invention will appear from the following description and the accompanying drawing.

BRIEF DESCRIPTION OF THE DRAWING

FIG. 1 is a plan view of a plant support constructed in accordance with the teachings of this invention;

FIG. 2 is a front elevational view of a plant support of FIG. 1;

FIG. 3 is a plan view of another plant support construct in accordance with the teachings of the invention;

FIG. 9 is a perspective view of a support bracket constructed in accordance with the teachings of this invention;

FIGS. 10 and 11 are front and side elevational views of a rotatable hook constructed in accordance with the teachings of this invention.

DESCRIPTION OF THE PREFERRED EMBODIMENTS

Figure 5:
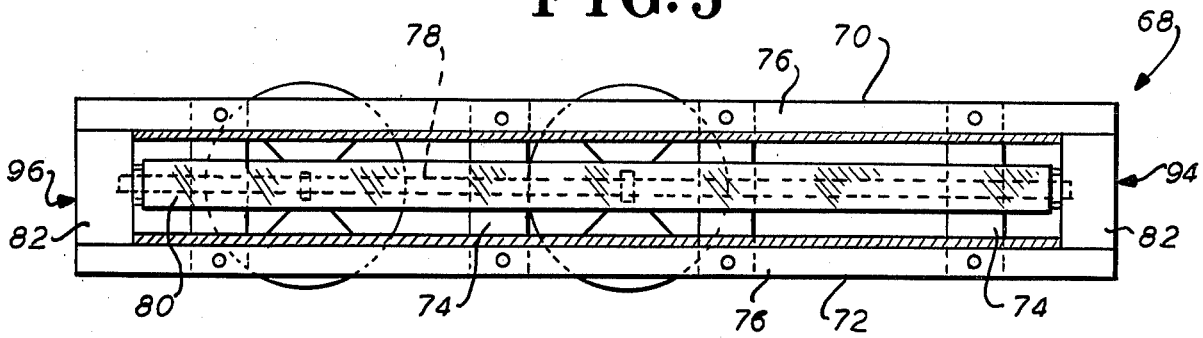
FIG. 5 is a partially sectioned plan view of the plant support of FIG. 4, taken along lines 5—5.

Turning to the drawing, there is disclosed a plant support 12 (FIGS. 1 and 2). The plant support 12 is provided with two parallel board-like members 14 and 16. Each board-like member 14 and 16 may be made of any structural material, such as wood, plastic, or metal. In the example set forth herein, the board is preferably made of wood. Each board 14 and 16 is defined by a dimension of length 18, width 20, and thickness 22. The boards 14 and 16 are disposed so that the larger surface areas 24, defined by the dimensions of length 18 and width 20, are placed parallel to one another with board ends 26 and 28 aligned. Holes 30 may be provided, as by drilling or the like, at regular intervals along the boards 14 and 16. Each hole 30 has the same dimensions. Each hole 30 in one board 14 is in registry with another hole 30 in the other board 16. The holes 30 may be arranged along median lines (not indicated) which bisect the width dimension 20 of the boards 14 and 16. The top edge 32 of each board 14 and 16 may have therein a plurality of holes 34, which may be formed by drilling.

The top edge 32 of each board 14 and 16 is defined by the dimensions of length 18 and thickness 22. The holes 34 may be drilled parallel to the front planar surface 24 of the boards 14 and 16. Each hole 34 may be located on a point defined by an imaginary line (not indicated) which bisects the thickness dimension 22 of each board 14 and 16. Each hole 34 is so located so as to intersect the center of the hole 30 passing through the side 24 of the boards 14 or 16. Each hole 34 extends below the side hole 30 and terminates within each of the boards 14 and 16. The purpose of the edge holes 34 will be more fully described hereinafter.

There is further provided a plurality of joining members 36 which may be made of any structural material, such as plastic, wood, or metal, and may be dowels. The outside dimension of each dowel 36 is a snug fit into the holes 30. Each dowel 36 may have a radially extending hole at each end. These holes have the same cross-sectional dimension as the hole 34 and are disposed so that, when the dowel 36 is within each of the side holes 30, the dowel holes may be aligned with the edge holes 34. The dowels 36 may also have a second hole extending diametrically at the mid-point of its axial length. The dowels 36 may be oriented so that the mid-point holes are aligned to receive therethrough a rod 38. The rod 38, like the dowels 36 and boards 14 and 16, may be made of any structural material, such as wood, metal, plastic, or the like. Whereas the dowels 36 and boards 14 and 16 may be made of wood, the rod 36 may, preferably, be made of a metal, such as steel. The opposed ends 26 and 40 and 28 and 42 of the boards 14 and 16, respectively, may each have L-shaped portions 4 and 46 facing one another. Each L-shaped portion 44 and 46 is so dimensioned so as to receive a substantially rectangularly-shaped 48 between the boards 14 and 16, so as to finish or cap the ends 26 and 40 and 28 and 42, respectively. The cap 48 may also take the form of a decorative end member or finial. The rectangular cap 48 may have therein an aperture disposed and so dimensioned as to receive the end of the rod 38 which has been disposed through the center holes in the dowels 36. Like the boards 14 and 16, the cap 48 may be made of any structural material, such as wood, plastic, or metal. The dowels 36 may be locked in place by any joining means, such as, for example, pins 50 which have been inserted into the edge holes 34. The end caps 48 may be secured to the boards 14 and 16 by any convenient joining means such as glue or nails.

By way of further example, the plant support 12 may be constructed of two boards 14 and 16, each having a length 18 of four feet, a width 20 of three inches, and a thickness 22 of one-half inch. Each of the side holes 30 through the boards 14 and 16 has a dimension of one inch. The edge holes 34 for admitting the pins 50 may have dimensions of three-sixteenths of an inch and be drilled to a depth of two and three-quarter inches. Each of the dowels 36 may have a diameter of one inch and a length of three inches with three-sixteenths of an inch holes, and be drilled to a depth of two and three-quarter inches. Each of the dowels 36 may have a diameter of one inch and a length of three inches with three-sixteenths of an inch holes at each end to be in registry with the edge holes 34, as well as a three-sixteenths of an inch hole at the center for receiving therethrough the rod 38. The caps 48 may have dimensions of three inches by two and one-half inches by a thickness of one-half of an inch, with a three-sixteenths of an inch rod-receiving hole having a depth of approximately three-sixteenths of an inch. It is not necessary that the rod 38 be secured or affixed to the dowels 36. Thus assembled, it is clear that the rod 38 is obscured from the side view by the boards 14 and 16. Furthermore, a plant container 52 may have secured thereto a wire hanger 54, constructed in a means well known in the art. At the end of the hanger 54 may be a hook 56 (shown in phantom in FIG. 2), as is well known in the art. It is immediately apparent that the boards 14 and 16 may obscure from view the hook portion 56, thereby giving a finished appearance to the plant support 12 and the plant container 52. The plant support 12 may be installed either by connecting directly to the ceiling (not shown) by bolts or hung from the ceiling by a chain, as is well known in the art. If the support 12 is increased in length and secured to a ceiling, the support 12 takes on the appearance of beams. The exposed side surfaces 24 of the boards 14 and 16 also provide a convenient means for decoration. Thus, in a preferred embodiment, the boards 14 and 16 are left in a natural wood finish and may have the dowels 36 disposed therethrough in the style of a pegged board. In the alternative, the dowels 36 may be recessed or hidden from view and the sides of the boards 14 and 16 may be painted or decorated with such materials as wallpaper or the like. Furthermore, it is not necessary that the structure be made of wood at all, but could be made entirely of metal, such as aluminum, chrome, or the like. Further, the dowels 36 need not be cylindrical. However, it is not merely the decorative aspects of this device which are important, but its ability to obscure from sight, in a closed-in relationship, the hook 56 of the hanger 54 for a plant container 52. The rod 38 permits the plant container 52 to be continually positionable so that any number of plant containers can be placed at any desired location, each with the hook 56 may be hidden from view. The hook 56 may be disposed upon the dowell 36, as well, with the same effect.

The device thus provides a versatile means for displaying hanging plants. Its simplicity and economy of design permits it to be hung from ceilings, installed within window frames, or be imitative of other room structures, such as ceiling beams.

As used hereinafter, similar structural elements are provided with identical reference numbers.

In still another form of the invention (FIG. 3), there may be provided a plant support 58 in a matrix form. Boards 14 and 16 may be spaced apart so that a board 60 of similar construction may be disposed therebetween. Side holes 30 in boards 14 and 16 are in registry with holes 30 in the board 60. Joining members or dowels 62 may be disposed through the holes 30 in the same manner as the dowels 36 of the first plant support device 12. Edge holes 34 may be drilled through the top edge 32 of each of the boards 14, 16, and 60. These holes may be aligned with holes formed in each of the dowels 62. Thus, as with the first plant support device 12, the dowel holes 34 would be located at each end of each dowel 62 to be in registry with the edge holes 34. A dowel hole may also be in registry with the hole 34 in the edge 30 of the board 60. The latter may be positioned at the axial center of the dowel 62. Diametrically extending holes may be disposed along the axial length of the dowel 62 and define the center point between each pair of parallel spaced boards 16 and 60 and 60 and 14, respectively. These dowel holes may be so dimensioned as to each receive a rod 38 therethrough. L-shaped cutouts 44 and 46 may be provided, as before, in the ends 26 and 40 and 28 and 42 of the boards 14 and 16, to receive at each end a cap member 64. The median board 60 may have a length dimension somewhat shorter than the length 18 of the boards 14 and 16, so as to be received within a routed-out portion 66 of each cap 64. This median board 60 may be secured to the caps 64 by nailing, gluing, or the like, as is well known in the art. The cap 64 may have apertures suitably disposed for receiving the rods 38 therein and the entire assembly may be held together by pins 50, nails, and glue, as previously indicated.

In a like manner, additional sections of parallel boards with rods supported therebetween may be connected to these two sections to thereby increase the capacity and size of the plant support 58.

Figure 4:
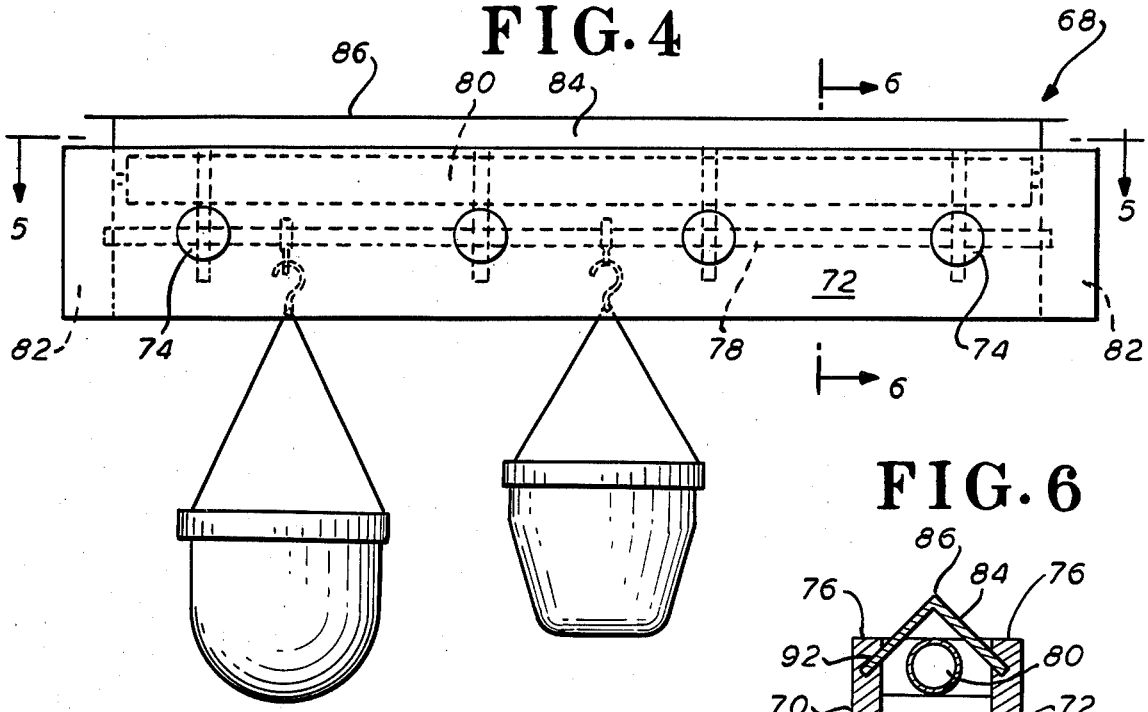
FIG. 4 is a front elevational view of a plant support constructed in accordance with the teachings of this invention.
Figure 6:
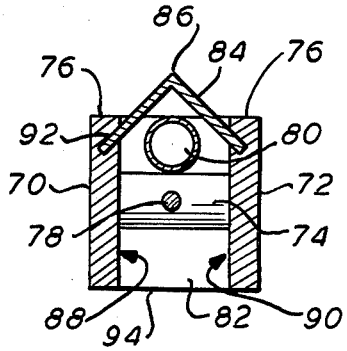
FIG. 6 is a left side sectional elevational view with the section taken along lines 6—6 of the plant support shown in Fig.
Figure 7:
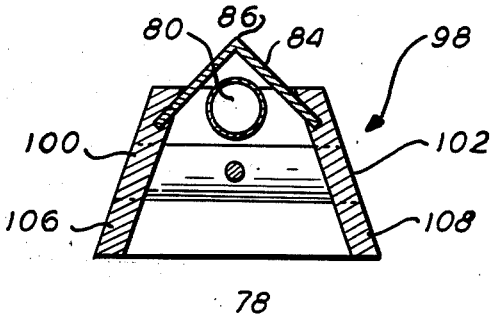
FIG. 7 is a left side sectional elevational view of another embodiment of the plant support disclosed in FIG. 4.

A further plant support 68 may be provided, which serves a dual function. Thus, for example, there may be provided (FIGS. 4 and 5) a pair of spaced parallel boards 70 and 72. These boards 70 and 72 may be interconnected by joining means as, for example, perpendicular dowel-like members 74 in the same manner as the dowels 36 or 62 held together the previously described boards 14 and 16 of the first plant support device 12 or boards 14, 16, and 60 of the second described plant support 58. Pins 50 inserted through edge holes 34 through the top edge surface 76 of each of the boards 68 and 70 and through the ends of the dowels 74 may secure the dowels 74 to the boards 70 and 72. Each of the dowels 74 may have extending diametrically through, at the axial center, another hole for admitting therethrough a rod 78. The plant support 68 (FIGS. 4 and 5) differs from the two previously described supports 12 and 58 in that the boards 70 and 72 and rod 78 are of such length as to accommodate a lighting fixture, preferably a fluorescent bulb 80. The bulb 80 may be proximate to or rest upon the top of the dowels 74 and be spaced parallel to the boards 70 and 72. The ends of the boards 70 and 72 may be joined at each end by housings 82. The housings 82 may have a generally rectangular shape and be made of any convenient material such as plastic, metal, or the like, and be secured to the boards 70 and 72 as by screws, clips, adhesive, or the like (not shown). Within the housings 82 there may be a fluorescent socket, ballast, and electrical wire (for providing power) (not shown), as is commonly known in the art, so that the bulb 80 may be engaged and electrified. A reflector 84 (FIGS. 4 and 6) may be made of any common material, as is well known in the art, such as plastic. The reflector 84 may have a generally "V" shape with the apex 86 aligned parallel to the bulb 80. In assembly, the boards 70 and 72 may be secured together by the disposition of the edge dowels 74 within the side holes 30 and the insertion of the pins 50 into edge holes 34, as well as the rods 78 through the dowels 74, as previously described in connection with the previous supports 12. Each of the boards 70 and 72 may be provided at the top inner surface thereof 88 and 90 (FIG. 6) with grooves 92 angularly disposed to complement the sides of the V-shaped reflector 84. The reflector 84 is inserted along the length of the grooves 92. One housing 82 may be secured at one end 94 of the support 68 and the bulb 80 inserted, and the second housing 82 secured at the other end 96 of the boards 70 and 72 and engage the bulb 80, thereby completing the structure 68. As disclosed thus far, the plant support 68 provides a unique combination for a plant support. It is not essential, of course, that a reflector 84 be used. Further, the boards 70 and 72 may be so dimensioned as to cover the reflector 84. To further enhance the light-disbursing characteristic of the plant support 68, a support 98 (FIG. 7) may be provided with canted side walls or boards 100 and 102. These side walls 100 and 102 may be canted in toward the reflector 84. The interconnecting dowels 104 may have the ends thereof finished at an angle with reference to the radius thereof to conform to and be co-planar with the exterior sides 106 and 108 of the side walls 100 and 102, respectively. As with the previously described plant support 68, the bulb 80 may be covered by the reflector 84.

Figure 8:
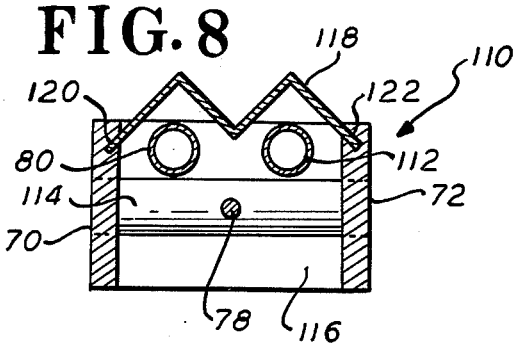
FIG. 8 is a left side sectional elevational view of another embodiment of the plant support device of FIG. 4.

Still another embodiment of a plant support device 110 using artificial illumination may be seen (FIG. 8), in which two bulbs 80 and 112 are disposed about dowels 114. Dowels 114, in turn, interconnect the side walls 70 and 72. The dowels 114 further support a rod 78. The dowels 114, however, are of sufficient length so as to accommodate both fluorescent bulbs 80 and 112. The end housings 116 may have a suitable ballast and fluorescent tube sockets (not shown) to complete the support 110. A W-shaped reflector 118 may engage complementary grooves 120 and 122 formed in the inner surface 88 and 90 of the side board 70 and 72. It may also be desired to have more than one rod 78 through the dowels 114.

As previously indicated, the plant support 12 herein may be joined to the ceiling by any commonly known means. One method of joining, however, may be to provide a bracket support 124 (FIG. 9). The bracket support 124 may be made of any structural material such as, for example, a continuous piece of steel having a generally rectangular shape. The end 126 of the rectangularly shaped bracket 124 may be bent or curved into the form of a hook. The hook end 126 may be cut out or notched into two tines 128 and 130. The curvature of the hook 126 may have, for example, a dimension sufficient to grasp the curved dowel 36. The space 132 defined between the tines 128 and 130 may be such as to permit the rod 38 to pass conveniently and freely therebetween. The upper end of the bracket 124 may be a laterally extending portion 134 which extends outwardly and away from the hook portion 126. Within the lateral portion 134 may be an elipsoid aperture 136. In use (FIG. 2), the hook end 126 is disposed around the dowels 36. A decorative chain (not shown) may be slipped through the elipsoid aperture 136 and turned so as to engage the lateral portion 134. The chain, in turn, may be secured to a ceiling as by a molly bolt or the like, as is well known in the art.

As previously indicated, plant containers 52 may be hung from hangers 54 and suspended directly by the rod 38. In an alternative embodiment (FIGS. 2, 10, and 11), there may be provided a rotatable hook mount 138. The rotatable hook mount 138 so suspends the hook 56 of the plant container 52 so that it may be freely rotatable while being suspended, in turn, from the rod 38 (FIG. 1). Thus, there may be provided a V-shaped spring clip 140 which may be made of flat spring steel. The apex end of the spring clip 140 may have a substantially arcuate portion 142 which narrows to a neck 144 for engaging the rod 38. Extending outwardly from the neck 144 of the V-clip 140 are the legs 146 and 148. Each leg 146 and 148 terminates in hooks 150 and 152, extending inwardly of the V-clip 140. A hook member 154 may be provided, having a rod-like upper end 156. A substantially cup-shaped member 158 may have an aperture at its base for admitting the stem 156 of the hook member 154. The end 160 of the stem 156 may be enlarged so as to prevent the hook member 154 from being removed from the cup 158. In assembly, the spring clip 140 is inserted over the rod 38. The arcuate portion 142 engages the rod 38 and is held in place by the neck 144. The cup member 158 is inverted and threaded on to the hook member 154 and up the stem 156 to the enlarged portion 160. The legs 146 and 148 of the clip 140 are spread so as to admit the side of the inverted cup 158 therein, with the hook ends 150 and 152 grasping the interior of the cup 158. With the hook 56 of the hanger 54 suspended from the hook member 154, the weight of the plant container 52 will cause the stem 156 to rotate in the inverted cup 158.

What is claimed is:

1. A plant support of the type intended to be suspended in a horizontal plane from a horizontal or vertical surface and from which plant containers or other objects are suspended from hooks, said support comprising:

(a) at least one pair of rigid members having substantially planar surfaces parallel to one another;

(b) at least one rod-like member spaced from said rigid members so as to be capable of receiving thereon the hooks; said rigid members being substantially wider than and enclosing said rod, such that said rod is obscured from view by said rigid members with the plant container or other object in view; the ends of said rigid members being substantially in registry with one another;

(c) joining means, at least one of said joining means being secured to each of said ends of said rigid members to thereby define a frame; said joining means being secured perpendicularly to said planar surfaces of said rigid members at regular intervals therealong and at least one of said joining means being capable of receiving thereon the hooks, the hooks being obscured from view from any side of said suspended frame; and (d) means for suspending said frame from the surfaces.

2. A plant support as recited in claim 1, further comprising a plurality of said rigid members and said rods each substantially parallel to one another, at least one rod being disposed between each pair of said parallel rigid members, said joining means being secured to said parallel rigid members for supporting said rod.

3. A plant support as recited in claim 1, wherein said joining members each having an aperture therethrough for receiving therein said rod.

4. A plant support as recited in claim 3, wherein said rigid member comprises substantially rectangular board-like members, each having the long dimension thereof aligned parallel to one another, said joining members comprise dowel-like members secured to said boards along an imaginary line extending parallel to the longest sides of said boards and approximately one-half the length of the shortest dimension, said support further comprises end members for being secured to said board-like members at their respective ends and for engaging said opposed ends of said rod.

5. A plant support as recited in claim 4, further comprising a plurality of said boards, each disposed parallel to one another, and a plurality of rods, there being one less rod than said boards, each of said rods being disposed between said boards, said joining members securing said boards to one another and receiving said rods therein.

6. A support device as recited in claim 1, wherein there being a plurality of said rod-like members and said joining members forming, in combination, a matrix to receive thereon the hooks.

7. A plant support as recited in claim 6, wherein said rigid members comprise board-like members, each having the widest dimension thereof aligned parallel to one another.

8. A plant support device as recited in claim 1, 3, 6 or 7, further comprising means for illumination secured between said rigid members.

9. A plant support device as recited in claim 8, wherein said means for illumination further comprises incandescent bulb means and means for illuminating said bulb, said bulb being disposed on top of said rod, such that the hooks are capable of engaging said rod and being illuminated by said bulb.

10. A plant support device as recited in claim 8, wherein said means for illumination further comprises fluorescent bulb means and means for illuminating said bulb, said bulb being disposed on top of said rod, such that the hooks are capable of engaging said rod and being illuminated by said bulb.

11. A plant support device as recited in claim 10, further comprising reflector means secured to said rigid members and above said bulb so as to reflect said light downwardly and upon said rod.

12. A plant support device as recited in claim 11, further comprising at least two of said bulbs being disposed between said members.

13. A plant support device as recited in claim 11, wherein said reflector means comprises board-like members, each being parallel to one another and disposed along the longest dimension of said rigid boards in intersecting planes, so as to form shade means for said bulb.

* * * * *